US005174471A

United States Patent [19]

Kozlowski et al.

[11] Patent Number: 5,174,471

[45] Date of Patent: Dec. 29, 1992

[54] CHILD-PROOF TABLET DISPENSER

[75] Inventors: Edward Kozlowski, Southport; Lance Liljeqvist, Wilton; Mathew Murray, Norwalk, all of Conn.

[73] Assignee: Miles Inc., Elkhart, Ind.

[21] Appl. No.: 896,212

[22] Filed: Jun. 10, 1992

[51] Int. Cl.[5] ..... A47F 1/04

[52] U.S. Cl. ..... 221/154; 221/202; 221/243; 221/256; 221/263; 206/536

[58] Field of Search ..... 221/152, 154, 202, 243, 221/256, 263, 264, 282; 206/536, 540; 222/153; 220/346, 347, 350

[56] References Cited

U.S. PATENT DOCUMENTS

| | | | |
|---|---|---|---|
| 2,774,470 | 12/1956 | Q'Port | 221/202 X |
| 3,313,451 | 4/1967 | Rhindress | 221/243 |
| 3,888,350 | 6/1975 | Horvath | 206/531 |
| 4,126,224 | 11/1978 | Laauwe et al. | 206/540 |
| 4,354,619 | 10/1982 | Wippermann et al. | 221/263 |
| 4,492,316 | 1/1985 | Emms | 221/202 |
| 4,561,544 | 12/1985 | Reeve | 206/540 |
| 4,564,124 | 1/1986 | Burton | 221/263 |

*Primary Examiner*—David H. Bollinger
*Assistant Examiner*—Dean A. Reichard
*Attorney, Agent, or Firm*—Louis E. Davidson

[57] ABSTRACT

A child-proof dispenser for pharmaceutical tablets capable of dispensing such tablets one at a time is disclosed. A sliding drawer with an open-topped tablet receptacle moves from a first position inside the dispenser where a tablet drops into the receptacle from a storage chamber to a second position outside of the dispenser. During this movement, a horizontal extension on the drawer prevents any further tablets from dropping out of the storage chamber. When the drawer is in the first position, detent means on such drawer mate in locking relation with detent means on a flexible arm of a locking member to prevent any movement of the drawer. Digital pressure on the flexible arm of the locking member will move the appropriate detent means out of locking relation to enable the drawer to move out and dispense the tablet.

2 Claims, 3 Drawing Sheets

CHILD-PROOF TABLET DISPENSER

BACKGROUND AND PRIOR ART

Many pharmaceutical products are marketed in the form of tablets. Some of these tablets are relatively small. As such, these small tablets are inconvenient to handle, especially by older persons who may have reduced mobility in their hands. There is thus a need for a dispenser for such tablets for convenient handling thereof. Such dispenser should be able to dispense the tablets one at a time. In order to protect immature individuals from being able to obtain tablets from such dispenser, it should be child-proof in its operation. However, it should not be so difficult to operate that the above older individuals will be unable to dispense the tablets.

Tablet dispensers capable of dispensing such tablets one at a time are known in the art. U.S. Pat. Nos. 2,774,470; 4,354,619 and 4,492,316 are representative of such prior art. These prior art dispensers, however, do not have any child-proof or child-resistant features. Dispensers or containers having features which make them difficult for small children to open are also known in the art. U.S. Pat. No. 3,888,350 and 4,561,544 are representative of such prior art. There is no known prior art that discloses or suggests the unique combination of a tablet dispenser capable of dispensing tablets one at a time and which is also easy to operate while at the same time being child-proof.

SUMMARY OF THE INVENTION

In accordance with the present invention, a child-proof dispenser for pharmaceutical tablets capable of dispensing such tablets one at a time is provided which comprises an enclosed tablet storage chamber formed by first and second vertical side-walls, third and fourth vertical endwalls, a top member and a bottom member having an opening therein located near the fourth vertical endwall, said opening having dimensions to allow any tablets stored in said chamber to pass therethrough in a vertical single-file column, said bottom member comprising a ramp which slopes downwardly from the third vertical endwall toward the fourth vertical endwall and which has side portions which slope inwardly from the first and second vertical sidewalls, a housing member attached to at least some of the walls of said chamber, a drawer member and a locking member, said housing member supporting said drawer member and said locking member, said locking member having at least one detent means attached to a flexible arm, said drawer member having an open-topped receptacle therein with a horizontal extension means coplanar with the open top of said receptacle and at least one detent means, said receptacle having dimensions such as to retain a single tablet in a vertical position, said drawer member capable of moving from a first position wherein said drawer receptacle communicates with said opening in said storage chamber bottom member allowing a single tablet to drop into said receptacle and wherein said locking member detent means is in locking relation to said drawer member detent means to a second position wherein said drawer receptacle is outside of said dispenser housing member allowing access to a tablet in said receptacle and said horizontal extension is located beneath said storage chamber bottom member opening to prevent any further tablets from passing through said opening, said locking member flexible arm capable of being moved by digital pressure to move said locking member detent means out of locking relation with said drawer member detent means to enable said drawer member to move from said first position to said second position.

DESCRIPTION OF THE INVENTION

Figure 3:
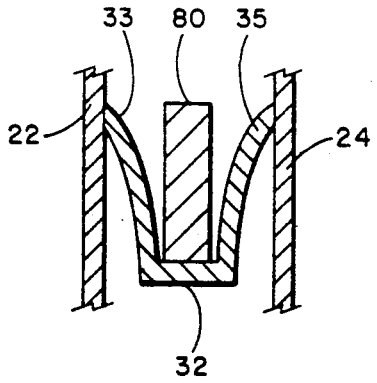
FIG. 3 is a vertical cross-section of a portion of the storage chamber bottom member ramp and a tablet contained therein along the plane 3—3 in FIG. 1.

As shown in FIGS. 1-4, the tablet dispenser 12 of the present invention comprises a tablet storage chamber 14, a housing member 16, a drawer member 18, and a first locking member 20. The enclosed storage chamber 14 is formed by first vertical sidewall 22, second vertical sidewall 24, third vertical endwall 26, fourth vertical endwall 28, top member 30, and bottom member 32. Bottom member 32 slopes downwardly from endwall 26 toward endwall 28 in the form of a ramp which terminates short of such endwall 28 to form an opening 34. Such opening forms the bottom exit from chamber 14. Bottom member 32 also has vertical portions or sidewalls 33 and 35 which slope inwardly from the chamber sidewalls 22 and 24 toward the bottom 32 as shown in FIG. 3.

Figure 1:
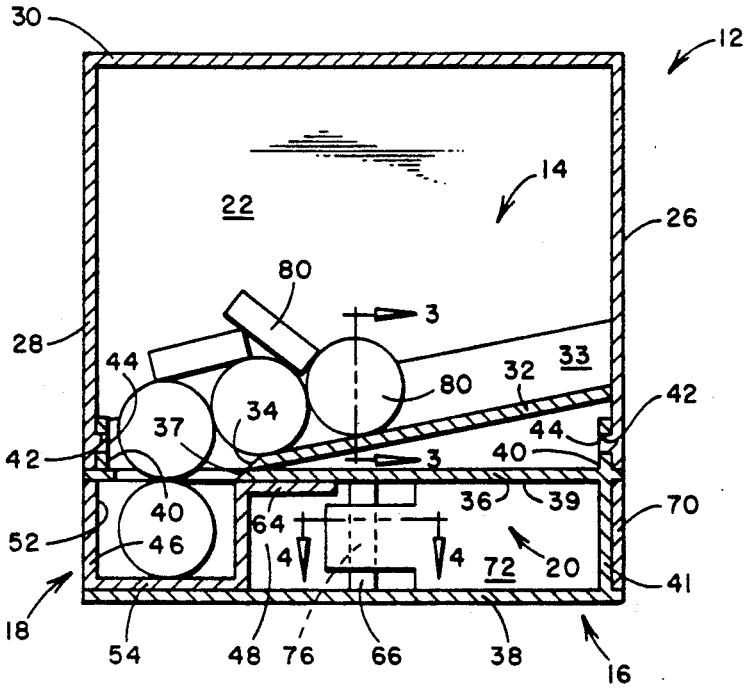
FIG. 1 is a vertical cross-section of a dispenser of the present invention with the dispensing drawer in a first closed position.
Figure 2:
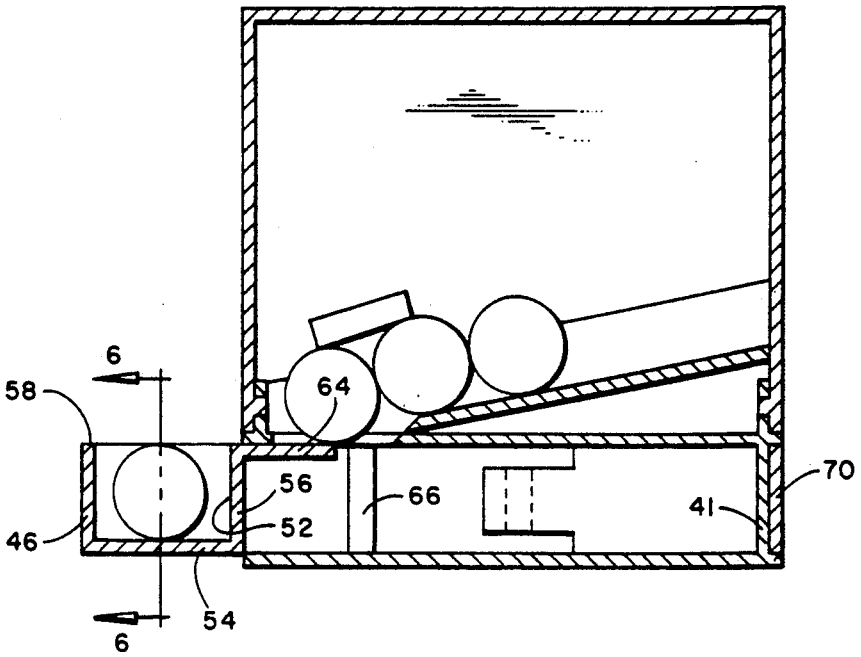
FIG. 2 is a vertical cross-section of the dispenser with the dispensing drawer in a second open position.

Housing member 16 is formed as a unitary member having an upper horizontal portion 36 and a lower horizontal portion 38 forming a channel 39 therebetween. Portion 36 has an opening 37 located therein which is in alignment with and communicates with opening 34 in bottom member 32. Portions 36 and 38 are connected by spacer means 41. Housing member 16 is attached to at least some of the walls of the storage chamber 14 in any convenient manner. One manner is shown in FIG. 1. Housing member 16 can have vertical extensions 40 with transverse openings 42 therein. Endwalls 26 and 28 can have horizontal detents 44 which extend into and mate with openings 42.

Figure 6:
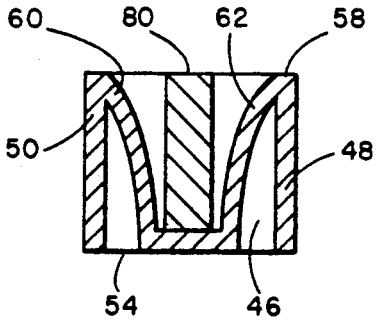
FIG. 6 is a vertical cross-section of a portion of the drawer member receptacle and stored tablet along the plane 6—6 of FIG. 2.

Drawer member 18 has a vertical endwall 46 and first vertical sidearm 48 and second vertical sidearm 50 attached thereto. Sidearm 48 has a vertical detent means 66 located along the inner end thereof, and sidearm 50 has a vertical detent means 68 located along the inner end thereof. Member 18 has a receptacle 52 formed therein with a bottom 54, a vertical endwall 56 and a top opening 58. Receptacle 52 preferably has vertical sidewalls 60 and 62 which slope inwardly from the top opening 58 toward the bottom 54 as shown in FIG. 6. Drawer member 18 has a horizontal extension 64 which is coplanar with top opening 58. Drawer member 18 is located in the channel 39 between top and bottom portions 36 and 38 of housing 16 and is supported thereby. When drawer member 18 is located in its first position, as shown in FIG. 1, the top opening 58 communicates with and is in alignment with openings 34 and 37 of the chamber bottom member 32 and top portion 36 of housing member 16, respectively.

First locking member 20 has a vertical endwall 70 and first flexible vertical sidearm 72 and second flexible vertical sidearm 74 attached thereto. Sidearm 72 is narrowed at its inner end with a vertical notch or detent means 76 therein along the outer surface thereof. The inner end of sidearm 72 also preferably has an inwardly curved portion 73. Sidearm 74 is narrowed at its inner end with a vertical notch or detent means 78 therein along the outer surface thereof. The inner end of sidearm 74 also preferably has an inwardly curved portion 75. First locking member 20 is located in the channel 39 between top and bottom portions 36 and 38 of housing 16 and is supported thereby.

Figure 4:
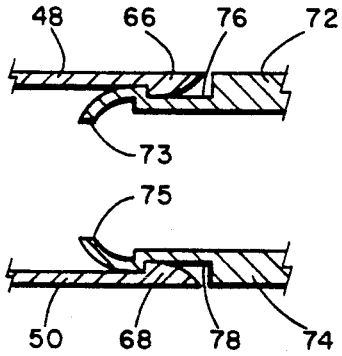
FIG. 4 is a horizontal cross-section of portions of the drawer member and the first locking member along the plane 4—4 of FIG. 1 with such members in locking relation.
Figure 5:
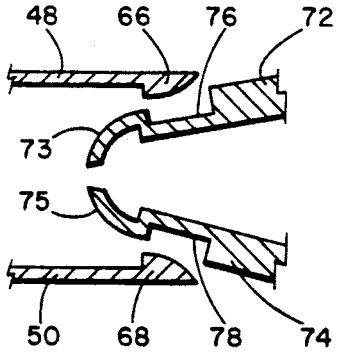
FIG. 5 is a view similar to that of FIG. 4 with such members not in locking relation.

When drawer member 18 is in its first position shown in FIG. 1, the detent means 66 and 68 thereof are in locking mating relation with the detent means 76 and 78, respectively, of first locking member 20. This is shown in FIG. 4. This locking relation prevents any movement of the drawer member 18. When inwardly directed digital pressure is applied to the outer surfaces of sidearms 72 and 74 of first locking member 20, the detent means 66, 68, 76 and 78 are moved out of locking mating relation as shown in FIG. 5. The flexibility of the sidearms 72 and 74 may be selected such that the digital pressure necessary to move the detent means out of locking relation is more than that of a child but not more than that of an elderly patient. In this situation, drawer member 18 can be pulled or moved out of housing member 16 by digital pressure to the second position shown in FIG. 2. It thus requires a combination of two movements to dispense a tablet. The locking member must be pushed in and the drawer must be pulled out. A child would normally not comprehend this. In this second position, the horizontal extension 64 of the drawer 18 at least partially covers the opening 37 of housing 16. When drawer 18 is pushed or moved again inside housing 16 to its first position, the curved ends 73 and 75 of sidearms 72 and 74 enable such sidearms to easily slip over the detent means 66 and 68 of the drawer 18 to allow such detent means to again mate with the detent means 76 and 78 of the first locking member 20.

In order to use this dispenser for dispensing tablets, the housing 16 is separated from the storage chamber 14 and such chamber is inverted with the top 30 on the bottom. The storage chamber 14 is then filled with an appropriate amount of tablets. The housing 16 is then attached to the storage chamber 14, and the combination is inverted to the normal position shown in FIGS. 1 and 2. The tablets 80 will then flow by gravity to cover the bottom member 32. The sloping sidewalls 33 and 35 of the bottom member or ramp 32 will maintain the tablets 80 in a vertical single file order along the ramp 32. The dimensions of the openings 34 and 37 of the bottom member 32 and housing 16, respectively, are such as to allow the tablets 80 to pass therethrough in a vertical single-file column into the receptacle 52 of drawer 18. The dimensions of receptacle 52 are such as to maintain a single tablet in a vertical position. When drawer 18 is moved from its first position inside housing 16 to its second position outside of housing 16, the horizontal extension 64 prevents any further tablets from passing through opening 37 of housing 16 The dispenser can then be inverted to allow the tablet to fall out of receptacle 52 into the hand of the patient who can then consume the tablet. The dispenser is then placed in its normal upright position, the drawer 18 is then pushed in to its first position wherein a new tablet is allowed to fall into receptacle 52 for further dispensing in the above-described manner.

Figure 7:
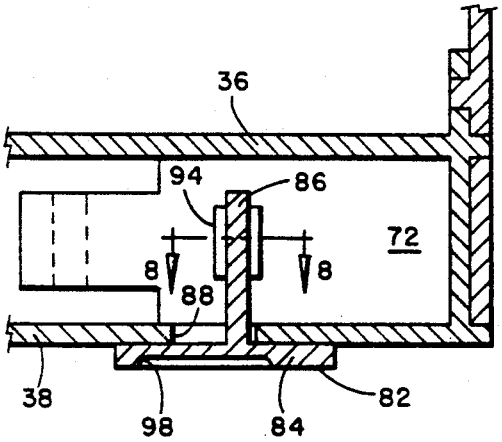
FIG. 7 is a vertical cross-section of a portion of the housing member and of the first and second locking members with such locking members in a mating relation.
Figure 8:
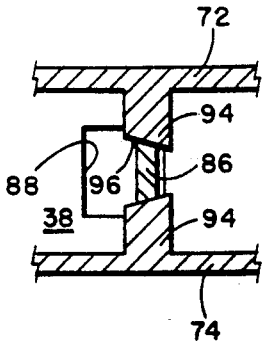
FIG. 8 is a horizontal cross-section taken along plane 8—8 of FIG. 7.
Figure 9:
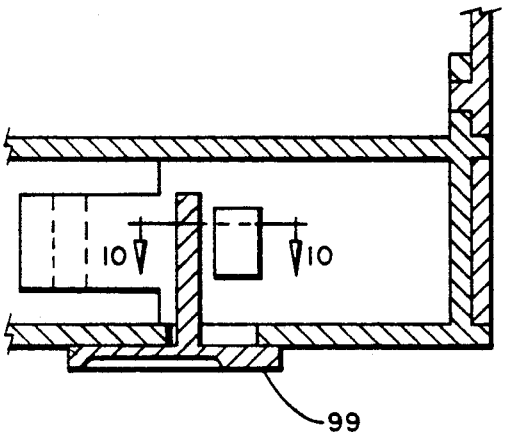
FIG. 9 is a view similar to that of FIG. 7 with the first and second locking members not in mating relation.
Figure 10:
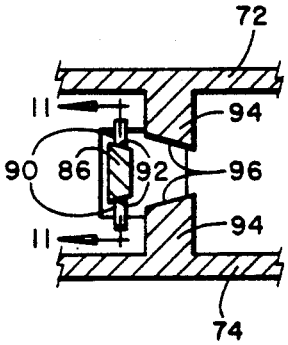
FIG. 10 is a horizontal cross-section along plane 10—10 of FIG. 9.
Figure 11:
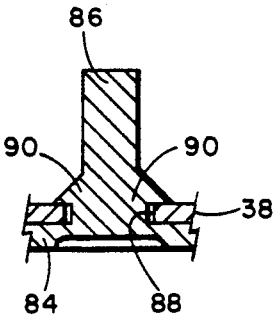
FIG. 11 is a vertical cross-section of portions of the second locking member and the housing along the plane 11—11 of FIG. 10.

A modification of the child-proof feature of the dispenser is shown in FIGS. 7–11. A second locking member 82 comprising a horizontal plate 84 and a vertical locking extension 86 is located beneath the housing lower portion 38 with extension 86 passing up through a elongated opening 88 in housing portion 38. Extension 86 has detent means 90 which mate against housing portion 38 to allow the housing portion 38 to support the second locking member 82. Extension 86 also has sloping surfaces 92. The sidearms 72 and 74 of the first locking member 20 have horizontal extensions 94, each having sloping surfaces 96 which are complimentary to the sloping surfaces 92 of extension 86. When the second locking member 82 is in its first position as shown in FIGS. 7 and 8, extension 86 mates against extensions 94 to prevent sidearms 72 and 74 from being moved inward in the manner shown in FIGS. 4 and 5 to allow the drawer 18 to move out of the housing 16. When the second locking member 82 is moved to its second position as shown in FIGS. 9 and 10 by applying digital pressure thereto, extension 86 no longer mates against extensions 94, and the sidearms 72 and 74 are free to move. Plate 84 of the second locking member 82 preferably has an indentation 98 along its lower outer surface 99 to assist digital pressure in moving member 82 back and forth.

All of the components of this dispenser can be conveniently formed from appropriate organoplastic materials. It is preferred that to member 30 be transparent so that the supply of tablets in the storage chamber can be observed.

This tablet dispenser has the advantages of being capable of dispensing tablets one at a time and being easy to operate while at the same time being child-proof.

The tablet storage capacity of this apparatus can be varied by using storage chambers of different sizes. The lower dimensions of the chamber 14 can be maintained at constant values to easily mate against housing 16 while the heights of the vertical side-walls and endwalls could be of any desired values.

What is claimed is:

1. A child-proof dispenser for pharmaceutical tablets capable of dispensing such tablets one at a time comprising an enclosed tablet storage chamber formed by first and second vertical sidewalls, third and fourth vertical endwalls, a top member and a bottom member having an opening therein located near the fourth vertical endwall, said opening having dimensions to allow any tablets stored in said chamber to pass therethrough in a vertical single-file column, said bottom member comprising a ramp which slopes downwardly from the third vertical endwall toward the fourth vertical endwall and which has side portions which slope inwardly from the first and second vertical sidewalls, a housing member attached to at least some of the walls of said chamber, a drawer member and a locking member, said housing member supporting said drawer member and said locking member, said locking member having at least one detent means attached to a flexible arm, said drawer member having an open-topped receptacle therein with a horizontal extension means coplanar with the open top of said receptacle and at least one detent means, said receptacle having dimensions such as to retain a single tablet in a vertical position, said drawer member capable of moving from a first position wherein said drawer receptacle communicates with said opening in said storage chamber bottom member allowing a single tablet to drop into said receptacle and wherein said locking member detent means is in locking relation to said drawer member detent means to a second position wherein said drawer receptacle is outside of said dispenser housing member allowing access to a tablet in said receptacle and said horizontal extension is located beneath said storage chamber bottom member opening to prevent any further tablets from passing through said opening, said locking member flexible are capable of being moved by digital pressure to move said locking member detent means out of locking relation with said drawer member detent means to enable said drawer member to move from said first position to said second position.

2. A dispenser according to claim 1 wherein said locking member is a first locking member and having a second locking member supported by said housing, said second locking member capable of moving from a first position wherein it prevents said flexible arm detent means of said first locking member from moving out of locking relation with said drawer member detent means to a second position wherein it allows said first locking member flexible arm detent means to move out of locking relation with said drawer member detent means.

* * * * *